US005902165A

United States Patent [19]

Levine et al.

[11] Patent Number: 5,902,165

[45] Date of Patent: May 11, 1999

[54] FIELD EMISSION DEVICE WITH OVER-ETCHED GATE DIELECTRIC

[75] Inventors: Jules D. Levine, Dallas; Kenneth G. Vickers, Whitesboro, both of Tex.

[73] Assignee: Texas Instruments Incorporated, Dallas, Tex.

[21] Appl. No.: 08/677,694

[22] Filed: Jul. 10, 1996

Related U.S. Application Data

[62] Division of application No. 08/453,593, May 30, 1995, Pat. No. 5,621,272.

[51] Int. Cl.[6] ..... H01J 1/30; H01J 9/18

[52] U.S. Cl. ..... 445/24; 445/49; 445/50

[58] Field of Search ..... 445/24, 50, 49

[56] References Cited

U.S. PATENT DOCUMENTS

| | | | |
|---|---|---|---|
| 3,755,704 | 8/1973 | Spindt et al. . | |
| 3,812,559 | 5/1974 | Spindt et al. . | |
| 3,998,678 | 12/1976 | Fukase et al. | 445/24 |
| 4,857,161 | 8/1989 | Borel et al. . | |
| 4,940,916 | 7/1990 | Borel et al. . | |
| 5,194,780 | 3/1993 | Meyer . | |
| 5,225,820 | 7/1993 | Clerc . | |
| 5,482,486 | 1/1996 | Vaudaine et al. | 445/50 |
| 5,507,676 | 4/1996 | Taylor et al. | 445/24 |

FOREIGN PATENT DOCUMENTS 2687839 8/1993 France .

*Primary Examiner*—P. Austin Bradley
*Assistant Examiner*—Jeffrey T. Knapp
*Attorney, Agent, or Firm*—Warren L. Franz; Wade James Brady, III; Richard L. Donaldson

[57] ABSTRACT

An electron emitter plate (110) for an FED image display has an extraction (gate) electrode (22) spaced by an insulating spacer (125) from a cathode electrode including a conductive mesh (18). Arrays of microtips (14) are located in mesh spacings (16), within apertures (26) formed in extraction electrode (22) and subcavities (141) formed through apertures (26) in insulating spacer (125). Subcavities (141*a*) are open to row-adjacent and column-adjacent subcavities (141*b*, 141*c*) to form larger main cavities (144). Posts (143) of insulating spacer (125) separate diagonally-adjacent cavities (141*d*). Subcavities (141) are formed by over-etching a layer of insulating spacer material (25) through apertures (26) before or after forming microtips (14) through the same apertures (26). Over-etching reduces the dielectric constant factor of gate-to-cathode capacitance in the finished structure.

14 Claims, 6 Drawing Sheets

FIELD EMISSION DEVICE WITH OVER-ETCHED GATE DIELECTRIC

This is a division of application Ser. No. 08/453,593, filed May 30, 1995, now U.S. Pat. No. 5,621,272

TECHNICAL FIELD OF THE INVENTION

The present invention relates generally to electron emitting structures of the field emission type; and, in particular, to reduced cathode-to-gate capacitance arrangements for microtip emission cathode structures usable in FED field emission flat-panel image display devices.

BACKGROUND OF THE INVENTION

Examples of conventional electron emitting devices of the type to which the present invention relates are disclosed in U.S. Pat. Nos. 3,755,704; 3,812,559, 4,857,161; 4,940,916; 5,194,780 and 5,225,820. The disclosures of those patents are incorporated herein by reference.

A typical such structure, embodied as an electron emitter of an FED (field emission device) flat-panel image display device as described by Meyer in U.S. Pat. No. 5,194,780, is shown in FIGS. 1–5. Such device includes an electron emitter plate 10 spaced across a vacuum gap from an anode plate 11 (FIG. 1). Emitter plate 10 comprises a cathode electrode having a plurality of cellular arrays 12 of n×m electrically conductive microtips 14 formed on a resistive layer 15, within respective mesh spacings 16 (FIG. 2) of a conductive layer mesh structure 18 patterned in stripes 19 (referred to as "columns") (FIG. 5) on an upper surface of an electrically insulating (typically glass) substrate 20 overlaid with a thin silicon dioxide ($SiO_2$) film 21. An extraction (or gate) electrode 22 (FIGS. 1–3) comprises an electrically conductive layer of cross-stripes 24 (referred to as "rows") (FIG. 5) deposited on an insulating layer 25 which serves to insulate electrode 22 and space it from the resistive and conductive layers 15, 18. Microtips 14 are in the shape of cones which are formed within apertures 26 through conductive layer 22 and concentric cavities 41 of insulating layer 25. The microtips 14 are formed utilizing a variation of the self-alignment microtip formation technique described in U.S. Pat. No. 3,755,704, wherein apertures 26 and cavities 41 are etched after deposition of layers 22,. 25 and wherein a respective microtip 14 is formed within each aperture 26 and cavity 41. The relative parameters of microtips 14, insulating layer 25 and conductive layer 22 are chosen to place the apex of each microtip 14 generally at the level of layer 22 (FIG. 1). Electrode 22 is patterned to form aperture islands or pads 27 centrally of the mesh spacings 16 in the vicinity of microtip arrays 12, and to remove cross-shaped areas 28 (FIG. 3) over the intersecting conductive strips which form the mesh structure of conductor 18. Bridging strips 29 of electrode 22 are left for electrically interconnecting pads 27 of the same row cross-stripe 24.

Anode plate 11 (FIG. 1) comprises an electrically conductive layer of material 31 deposited on a transparent insulating (typically glass) substrate 32, which is positioned facing extraction electrode 22. The conductive layer 31 is deposited on an inside surface 33 of substrate 32, directly facing gate electrode 22. Conductive layer 31 is typically a transparent conductive material, such as indium-tin oxide (ITO). Anode plate 11 also comprises a phosphor coating 34, deposited over the conductive layer 31, so as to be directly facing and immediately adjacent extraction electrode 22.

In accordance with conventional teachings, groupings of the microtip cellular arrays 12 in mesh spacings 16 corresponding to a particular column-row image pixel location can be energized by applying a negative potential to a selected column stripe 19 (FIG. 5) of cathode mesh structure 18 relative to a selected row cross-stripe 24 of extraction electrode 22, via a voltage source 35, thereby inducing an electric field which draws electrons from the associated subpixel pluralities of n×m microtips 14. The freed electrons are accelerated toward the anode plate 11 which is positively biased by a substantially larger positive voltage applied relative to extraction electrode 22, via the same or a different voltage source 35. Energy from the electrons emitted by the energized microtips 14 and attracted to the anode electrode 31 is transferred to particles of the phosphor coating 34, resulting in luminescence. Electron charge is transferred from phosphor coating 34 to conductive layer 31, completing the electrical circuit to voltage source 35.

The various column-row intersections of stripes 19 of cathode mesh structure 18 and cross-stripes 24 of extraction electrode 22 are matrix-addressed to provide sequential (typically, row-at-a-time) pixel illumination of corresponding phosphor areas, to develop an image viewable to a viewer 36 looking at the front or outside surface 37 of the plate 11. However, even with row-at-a-time addressing, the per pixel addressing duty factor is small. For example, the pixel dwell time (fraction of frame time available to excite each pixel) for row-at-a-time addressing in a 640×480 pixel color display refreshed at 60 frames per second (180 RGB color fields per second), is only about 8–10 microseconds per row. This means that for pulse width modulated gray scale control, where the dwell time per pixel is further divided into as many as 64 dwell time subintervals, column voltage switching during row "on" times occurs at the rate of about once every 30–40 nanoseconds. At such high switching rates, total gate-to-cathode capacitance for the column stripes 19 becomes a significant factor in the RC time constant and has a predominant adverse influence on the $\frac{1}{2}CV^2$ power consumption factor. Some reduction in capacitance is achieved through the described patterning of gate electrode 22, wherein removal of gate electrode from areas.28 reduces capacitance away from the microtips. There remains, however, a pressing need to reduce the column gate-to-cathode capacitance even more in such field effect devices.

Spindt, et al., U.S. Pat. No. 3,812,559 (see FIG. 9 of the '559 patent) illustrates a conventional microtip emission cathode structure wherein a gate electrode is supported only at its periphery. This reduces gate-to-cathode capacitance due to the elimination of most of the gate supporting dielectric material present in structures such as that of Meyar '780, which have insulating material 25 completely surrounding each microtip 14. The '559 structure has no supports except at the periphery of the entire gate electrode and has the advantage of reducing capacitance especially for high frequency (viz. microwave frequency operations wherein gate-to-cathode capacitance has particularly adverse consequences. The Spindt '559 structure is, however, subject to several problems. First, except for very small structures, the lack of any support except at the periphery can lead to excess bouncing or vibration of the gate electrode, similar to vibrations encountered by a peripherally supported membrane. This so-called "trampoline" effect can lead to structure failure and undesirable variations of gate-to-cathode current flow. The large unsupported central region is also subject to other problems. In assembly of a display structure, glass balls or other spacers acting between the anode and cathode plates may cause unwanted physical deformation and even destruction of an unsupported gate. Also, during fabrication, surface tension of etching liquids used in wet etching steps (such as for removal of a sacrificial Ni layer) can cause the unsupported structure to break when the liquids are recovered. The unsupported gate region may also be subject to distortion due to electrical attraction between the positively charged gate and the negatively charged cathode.

SUMMARY OF THE INVENTION

The present invention provides an electron emitting structure of the field emission type having reduced cathode-to-gate capacitance. In particular,the invention provides a thin-film microtip emission cathode structure with reduced column cathode-to-gate dielectric constant, achieved through reduction in the mass of the insulating layer that serves to space cathode and gate electrode layers.

In accordance with embodiments of the invention, described further below, a field emission cathode structure formed using a self-aligning microtip fabrication process is given an exaggerated undercut etching, either during or after formation of the gate electrode apertures, thereby reducing the amount of insulating spacer material between aperture pads of the gate electrode and associated microtip cellular arrays of the cathode electrode. In illustrated embodiments, the microtips of each array are partially encompassed by individual subcavities which are communicated to form a single larger cavity. Each pad in the patterned gate electrode is located centrally above a cathode electrode mesh spacing, supported peripherally and on posts above the associated cathode microtip array.

By eliminating portions of the mass of insulating spacer material between the cathode mesh spacings and the gate pads, the average dielectric constant between the cathode and gate electrodes for each column is significantly reduced, thereby leading to an overall reduction in column cathode-to-gate capacitance. This reduces the RC time constant and the total power consumption of the resulting matrix-addressed pixel image.

BRIEF DESCRIPTION OF THE DRAWINGS

Embodiments of the invention have been chosen for the purpose of illustration and description, and are shown with reference to the accompanying drawings, wherein:

FIG. 1 is a view of the display corresponding to a section taken along the line 1—1 of FIGS. 2 and 4;

FIG. 2 is a top plan view of a portion of a pixel of the image forming area of the cathode plate of the display;

FIG. 3 is a view of the cathode plate laterally displaced from that of FIG. 1, corresponding to a section taken along the line 3—3 of FIGS. 2 and 4;

FIG. 4 is an enlarged top plan view, with gate electrode layer removed, of a central region of one mesh spacing of the display; and FIG. 5 is a schematic macroscopic top view of a corner of the cathode plate useful in understanding the row-column, pixel-establishing intersecting relationships between the cathode grid and pad-patterned gate electrodes shown in greater enlargement in FIG. 2.

FIGS. 6, 7 and 8 are views, respectively corresponding to FIGS. 1, 3 and 4, of a display incorporating an electron emitting structure in accordance with the invention;

FIGS. 9A–9G are schematic views showing steps in a method of fabrication of the structure of FIGS. 6–8; and FIGS. 10A–10F are schematic views showing steps in a modified method of fabrication of the same structure.

Throughout the drawings, like elements are referred to by like numerals.

DETAILED DESCRIPTION OF PREFERRED EMBODIMENTS

Figure 6:
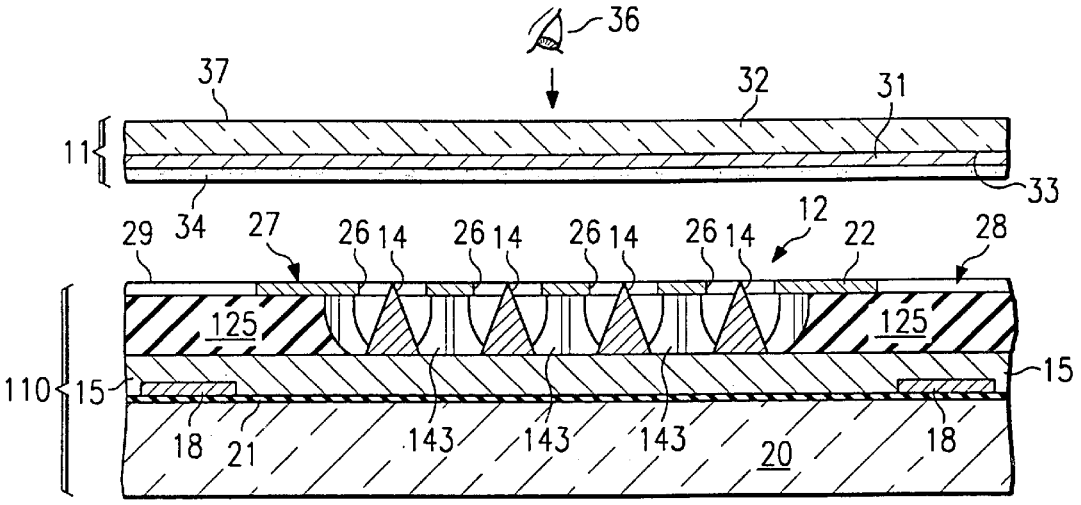
FIGS. 6–8, 9A–9G and 10A–10F illustrate embodiments of the invention.
Figure 7:
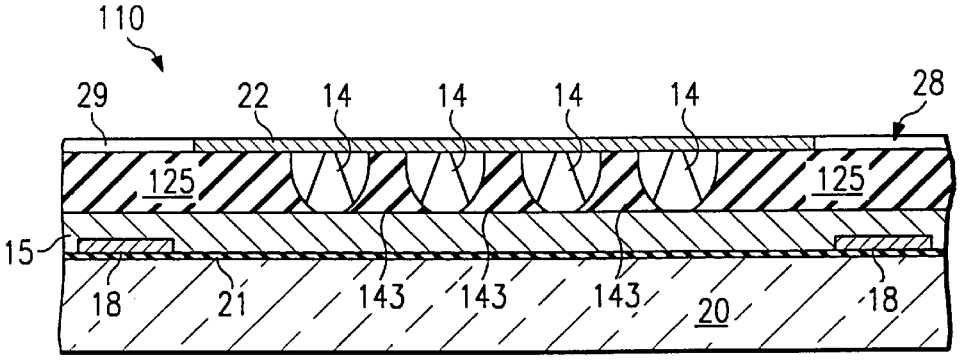
Figure 8:
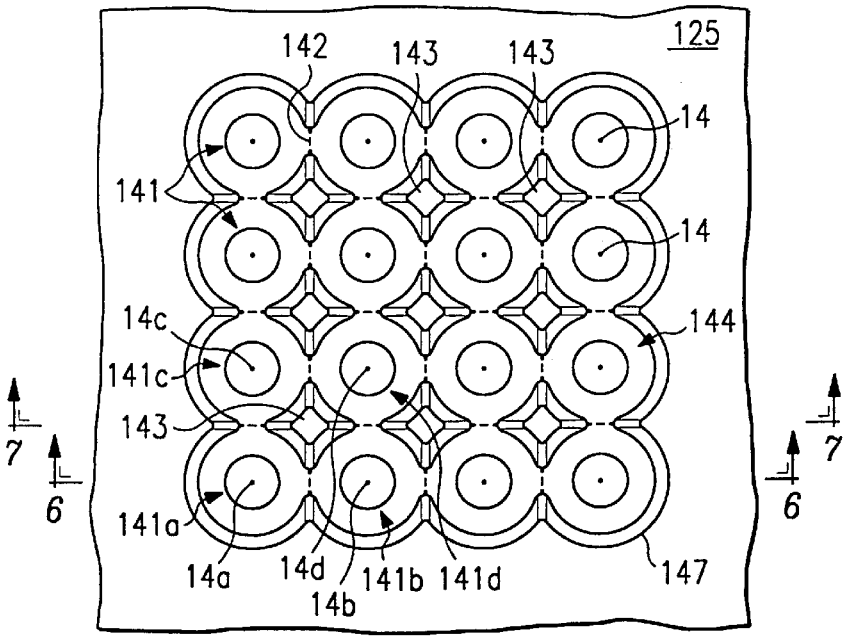

FIGS. 6–8 illustrate an embodiment of an FED flat-panel image display device, incorporating an electron emitter plate 110 fabricated in accordance with the teachings of the present invention.

As with the device of FIGS. 1–5, the emitter plate 110 is spaced across a vacuum gap from an anode plate 11, which may be identical to the anode plate 11 previously described. Likewise, in conformance with the previously described emitter plate 10, emitter plate 110 generally comprises a cathode electrode having a plurality of cellular arrays 12 of similar n×m electrically conductive microtips 14 formed on a resistive layer 15, within respective mesh spacings 16 (see FIG. 2) of a conductive layer mesh structure 18 patterned in column stripes 19 (see FIG. 5) on an upper surface of a glass or other substrate 20 overlaid with a thin silicon dioxide ($SiO_2$) film 21. Also, in conformance with the previously described emitter plate 10, the illustrated emitter plate 110 may have an extraction (or gate) electrode 22, patterned to form aperture islands or pads 27, each having an array of n×m apertures 26 in one-to-one correspondence with the microtips 14 and located centrally over a respective cathode electrode mesh spacing 16. The extraction electrode 22 comprises an electrically conductive layer of row-defining cross-stripes 24 (see FIG. 5) that run transversely to the stripes 19 defined by the cathode electrode mesh structure 18.

Figure 1:
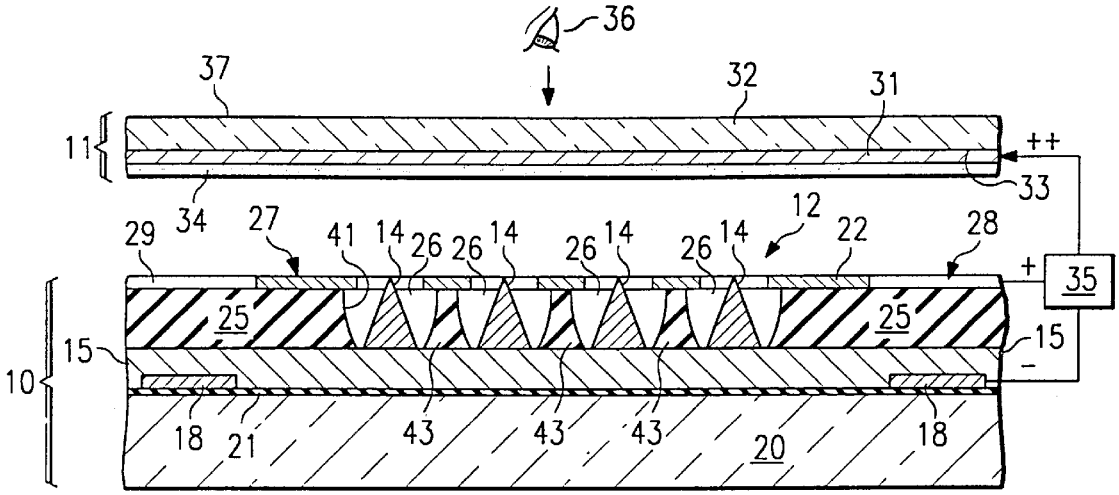
FIG. 1 (PRIOR ART)
FIGS. 1–5 (prior art) illustrate a typical "subpixel mesh" electron emitting structure fabricated utilizing conventional thin-film deposition techniques, and embodied in an FED flat-panel image display device.
Figure 2:
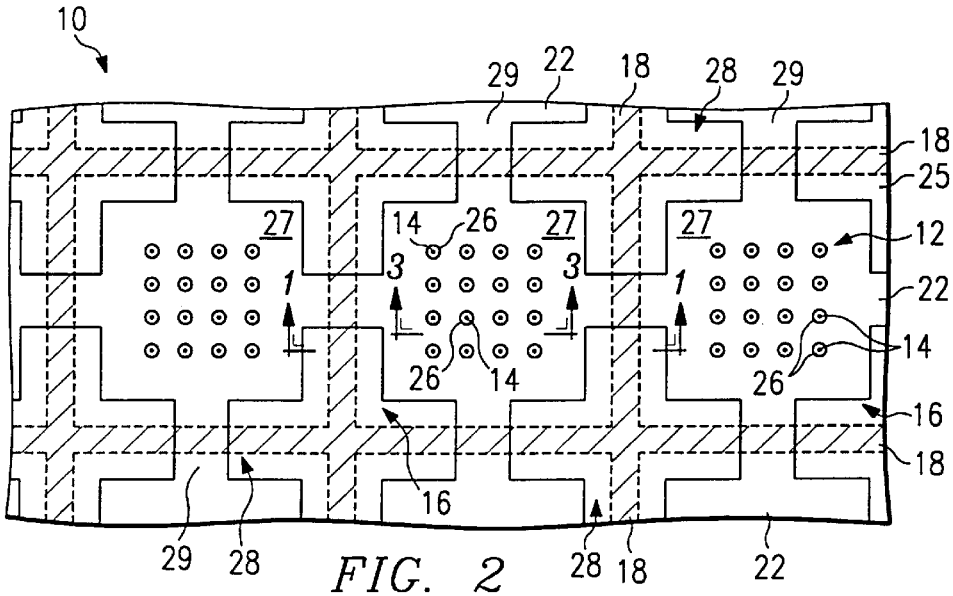
FIG. 2 (PRIOR ART)
Figure 3:
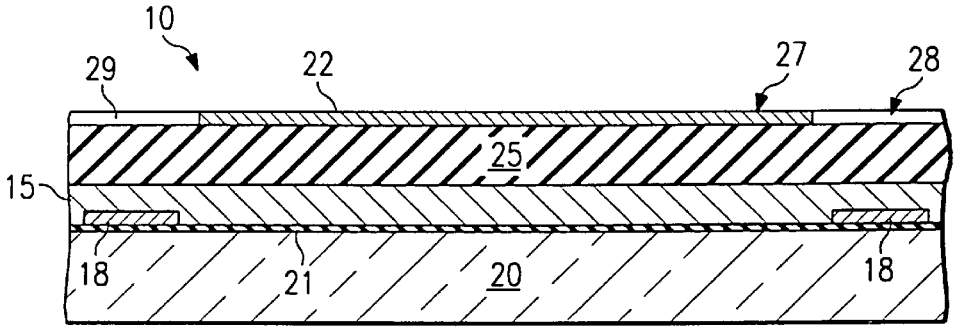
FIG. 3 (PRIOR ART)
Figure 4:
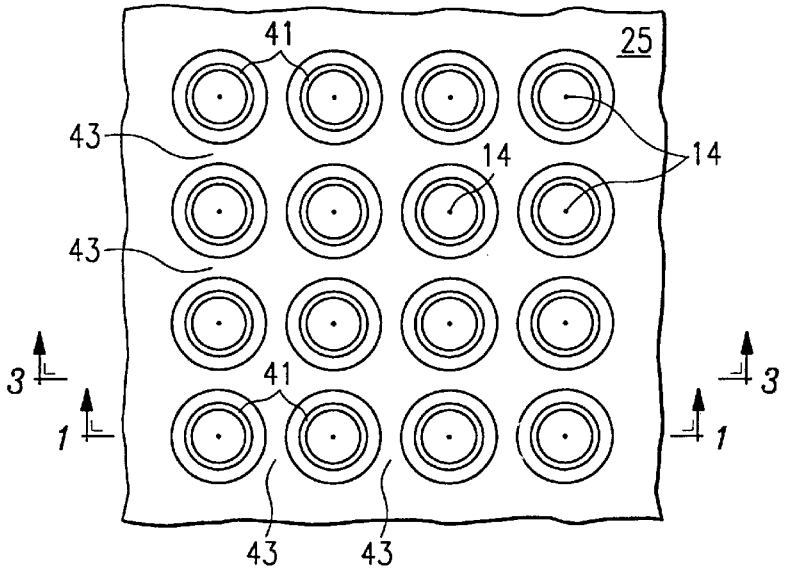
FIG. 4 (PRIOR ART)
Figure 5:
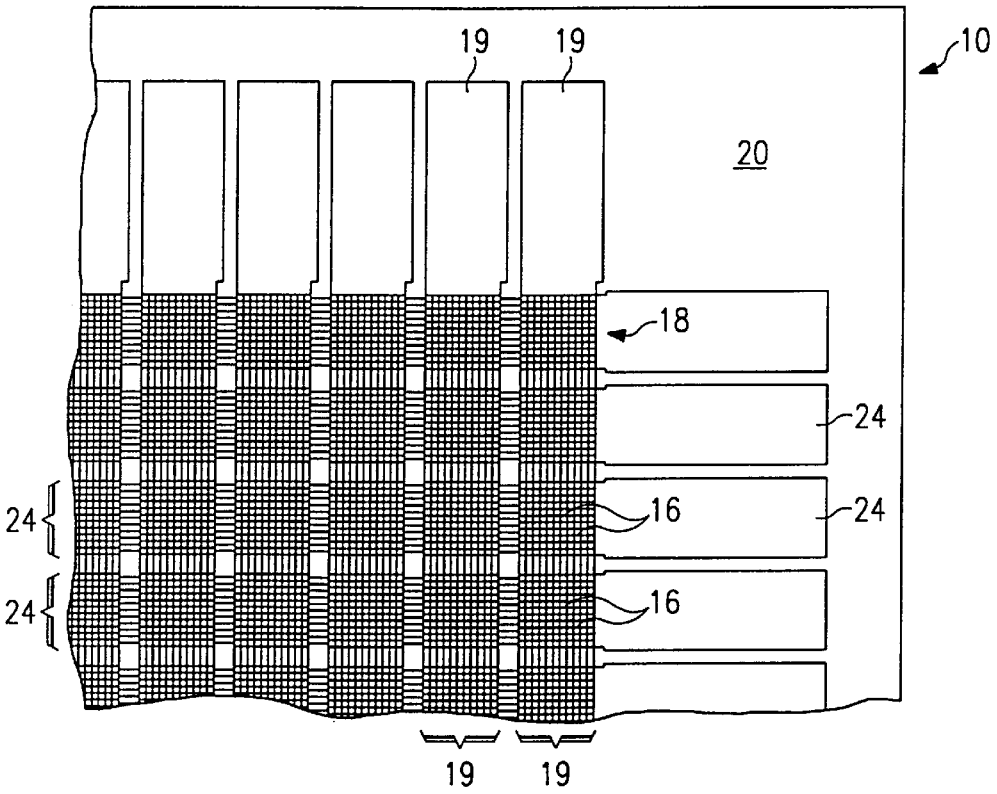
FIG. 5 (PRIOR ART)

Conductive layer 22 is spaced and insulated from resistive layer 15 and cathode mesh structure 18 by an intervening insulating layer 125 which corresponds to the layer 25 shown in FIGS. 1, 3 and 4. Unlike layer 25 however, layer 125 does not have discrete isolated cavities 41, formed concentrically about the site of each microtip 14, leaving unbroken partitions 43 separating row-adjacent, column-adjacent, and diagonally-adjacent ones of the cavities 41 of the n×m array microtips 14 (see FIGS. 1 and 4). Instead, the mass of insulating layer 125 has been reduced to remove partitions and provide openings between row-adjacent (14*a*, 14*b* in FIG. 8) and column-adjacent (14*a*, 14*c*) microtips 14, leaving partitions of insulating material 125 in the form of pillars or posts 143 only between diagonally adjacent (14*a*, 14*d*) microtips 14 of each array 12 (compare FIGS. 4 and 8). Thus, as shown in FIGS. 6–8, this reduction in mass of material 125 centrally of the mesh spacings 16 positions each microtip 14 within a subcavity 141 (shown in dot-dashed lines in FIG. 8), with the subcavities 141 placed in communication through openings 142 with column-adjacent and row-adjacent subcavities 141. In this way, the total of n×m microtips 14 of each array 12 are positioned within a single, common main cavity 144 formed centrally within each mesh spacing 16. The gate electrode layer 22 is supported peripherally of each pad 27 on insulative material 125 at the perimeter of larger cavity 144, on a boundary wall 147 defined by extremities of the outer subcavities 141 of each array 12. The portion 148 of layer 22 that defines the marginal edge of each pad 27 is supported on boundary wall 147. The portion 149 of layer 22 that defines the central region of each pad 27, which extends over the top of main cavity 144, is supported at regularly spaced intervals by the posts 143 which are left between diagonally-adjacent ones (e.g., 141*a*, 141*d*) of the subcavities 141. The size of apertures 26 in the arrangement of FIGS. 6–8 can be the same as the size of apertures 26 in the arrangement of FIGS. 1, 3 and 4, and similar self-alignment techniques can be used to obtain initial alignment of the subcavities 141 with apertures 26 and for forming microtips 14 in general concentric alignment within apertures 26 and subcavities 141. Following this, however, the boundaries of subcavities 141 are enlarged beyond those of the corresponding prior art cavities 41, to increase the diameters of subcavities 141 until column-adjacent (e.g., 141*a*, 141*c*) and row-adjacent (e.g., 141*a*, 141*b*) subcavities 141 become tangent or overlapping. For the illustrated embodiment, diagonally-adjacent subcavities (e.g. 141*a*, 141*d*) are separated by the posts 143.

Capacitance of the cathode plate structure 10 or 110 is proportional to the area and spacing of the separated conductive layers 18, 22 and to the magnitude of the dielectric constant of the material (viz. insulating layer 25 or 125) separating layers 18, 22. An electron emitting structure in accordance with the invention, as illustrated by the described cathode plate 110, has overall reduced capacitance because of reduced average dielectric constant resulting from elimination of insulating layer material (compare layer 125 with layer 25) and replacement of the same with the significantly lower dielectric constant of air (viz. vacuum), especially in the vicinity of highest electron concentration (viz. the microtip arrays 12, centrally of the mesh spacings 16). Accordingly, an image display device incorporating the principles of the invention exhibits a lower RC time constant and reduced $\frac{1}{2}CV^2$ power dissipation.

A conventional process for fabrication of thin-film microtip emission cathode structures of the type described with reference to FIGS. 1–5 is generally described in Spindt U.S. Pat. No. 3,755,704 and Meyer U.S. Pat. No. 5,194,780. Such process can be modified in accordance with illustrative embodiments of methods of the invention to fabricate the structures in accordance with the invention.

Figure 9A:
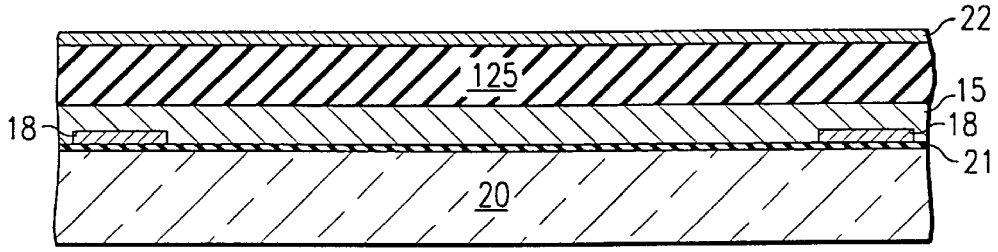

As shown in FIG. 9A, a cathode mesh structure 18, resistive layer 15, insulating layer 125 and gate electrode layer 22 are successively formed on an upper surface o a glass substrate 20, which has been previously overlaid with a thin layer 21 of silicon dioxide (SiO) of about 500–1000 Å thickness. The cathode structure 18 may, for example, be formed by depositing a thin coating of conductive material, such as niobium of about 2,000 Å thickness, over the silicon dioxide layer 21. The mesh pattern of structure 18 and connectors defining the columns 19 may then be produced in the conductive coating by photolithography and etching to give, e.g., mesh-defining strips of 2–3 micron widths, providing 25–30 micron generally square mesh spacings 16, at 11×10 mesh spacings per 300 micron pixel, with column-to-column separations of 50 microns (see FIG. 5). Resistive layer 15 may, for example, be formed as a resistive, undoped silicon coating of, e.g., 10,000–12,000 Å thickness, deposited by cathode sputtering or chemical vapor deposition over the patterned mesh structure 18 and mesh spacings 16 (see FIG. 2). Spacer layer 125 may, for example, be formed as a silicon dioxide ($SiO_2$) layer of 1.0–1.2 micron thickness deposited by chemical vapor deposition over the resistive coating 15. Gate electrode layer 22 may, for example, be formed by depositing a thin metal coating of niobium with, e.g., 2,000 Å thickness over the spacer layer 125.

Figure 9B:
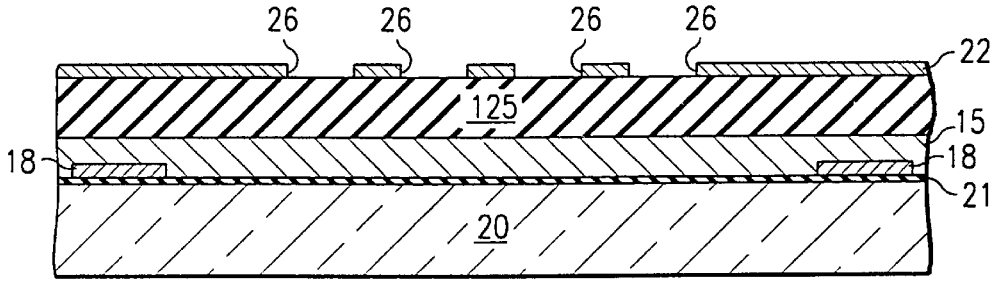
Figure 9C:
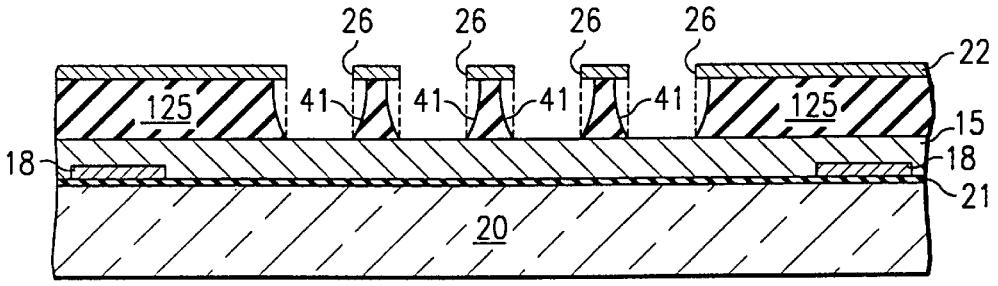
Figure 9D:
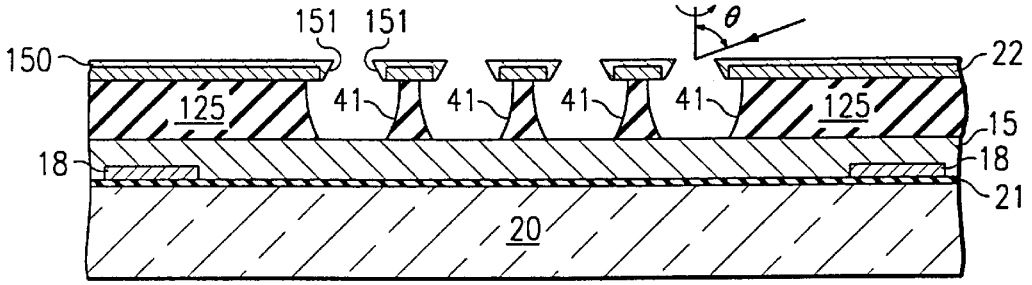
Figure 9E:
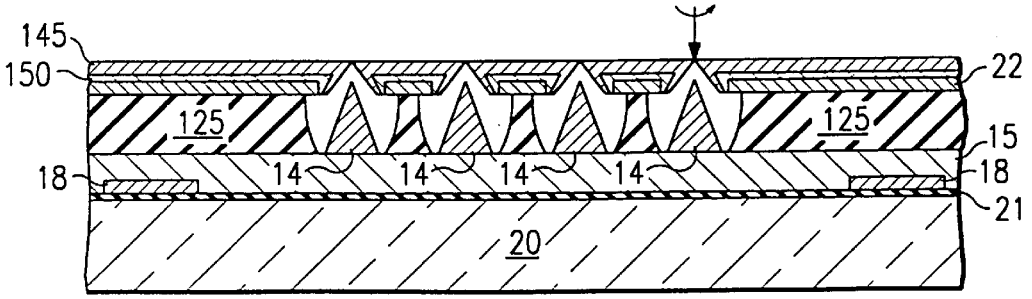
Figure 9F:
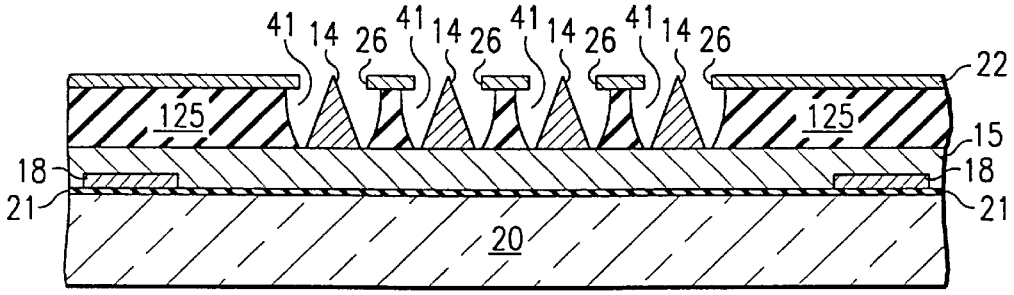
Figure 9G:
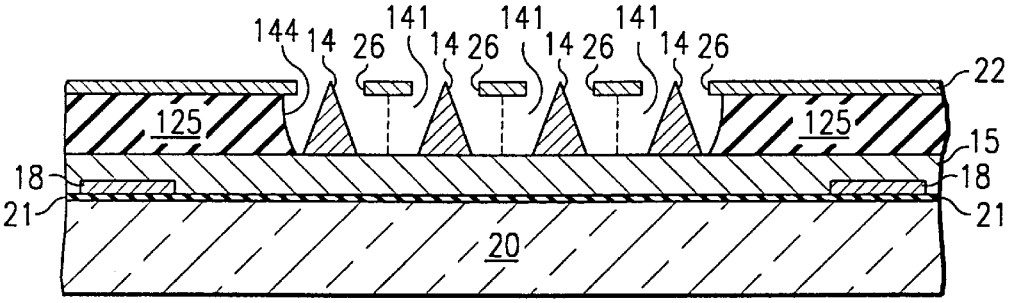

Next, as shown in FIG. 9B, gate layer 22 is masked and etched to define pluralities of arrays of n×m (e.g., 4×4) apertures 26 of 1.0–1.4 micron diameters, at 3 micron aperture pitches and 25 micron aperture array pitches. The insulating layer 125 is then subjected to a first etching to form pluralities of arrays of discrete cavities 41 in respective concentric alignments with and located beneath the apertures 26. Thereafter, as shown in FIG. 9D, while rotating the substrate 20, a sacrificial lift-off layer 150 of, e.g., nickel is formed by electron beam deposition over the layer 22. The beam is directed at an angle of 5°–20° to the surface (70°–85° from normal) so as to deposit lift-off layer material on the aperture circumferential walls at 151. Then as shown in FIG. 9E, with substrate 20 again being rotated, molybdenum and/or other conductive tip forming material is deposited on the inner surface of each cavity 41 by directing a beam substantially normal to the apertures 26 to form pluralities of arrays of n×m (viz. 4×4) microtips 14, self-aligned in respective concentric alignment within the n×m apertures 26 and n×m cavities 41 of each aperture array. Thereafter, as shown in FIG. 9F, superfluous molybdenum deposition 145 deposited over the nickel layer 150 is removed, together with the nickel layer 150. Then, in departure from the prior art, a second etching step is performed, as shown in FIG. 9G, to further etch away the walls of cavities 41 of material 125, resulting in the formation of enlarged overlapping subcavities 141 (see FIG. 6) and formation of a common larger main cavity 144 (see FIG. 8). For the shown embodiment, each subcavity 141 envelops one microtip 14, and each main cavity 144 envelops n×m subcavities 141 and n×m microtips 14. Each subcavity is open to row-adjacent and column-adjacent subcavities (e.g., subcavity 141*a* communicates with subcavities 141*b* and 141*c*). Posts 143 are left by unetched material 125 between diagonally-adjacent subcavities (e.g., a post 143 is located between subcavities 141*a* and 141*d*).

Figure 10A:
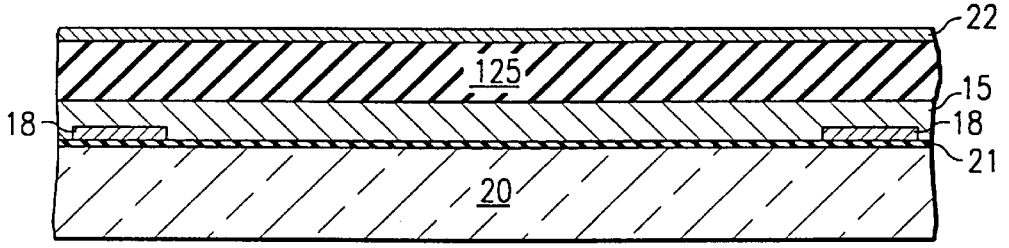
Figure 10B:
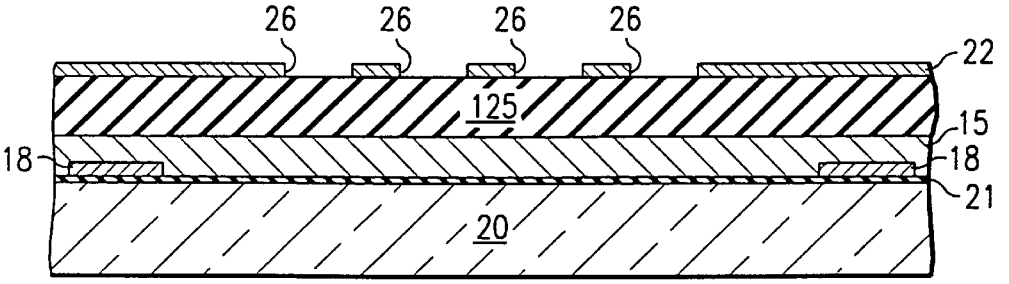
Figure 10C:
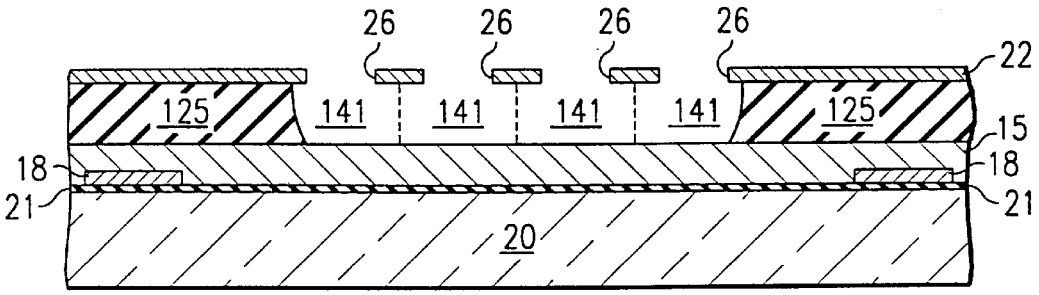
Figure 10D:
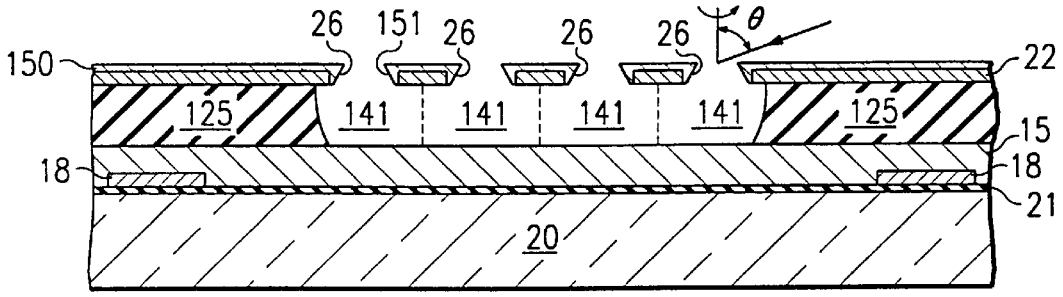
Figure 10E:
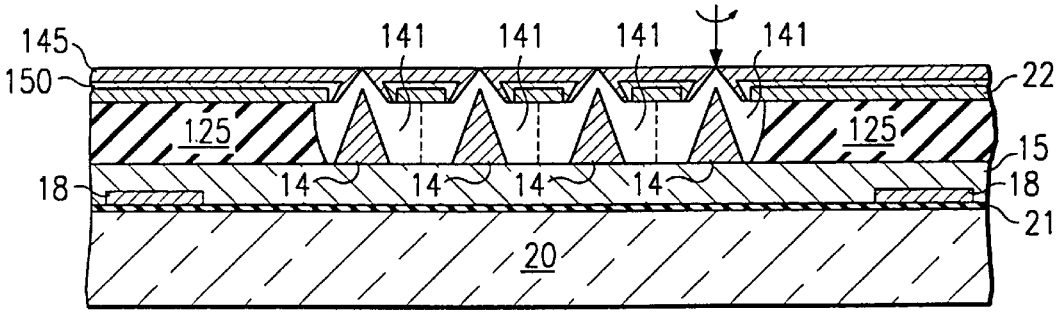
Figure 10F:
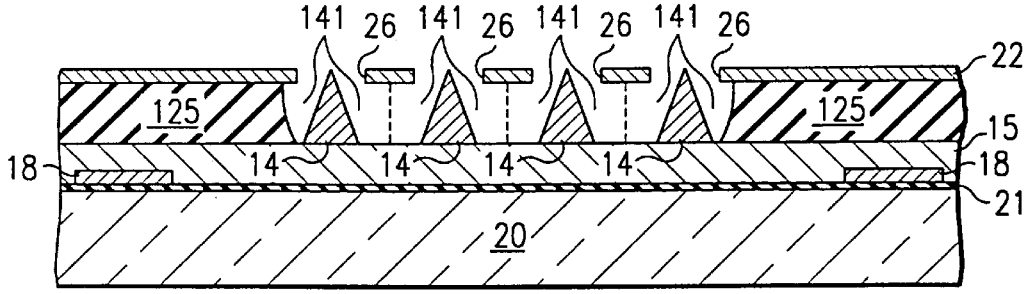

An alternative fabrication process is illustrated in FIGS. 10A–10F, wherein the larger cavity 144 is formed (as shown in FIG. 10C) before deposition of the lift-off layer 150 (FIG. 10D) and formation of the microtips 14 (FIG. 10E). The initial steps shown in FIGS. 10A and 10B can be the same as the steps described with reference to FIGS. 9A and 9B, above. The later steps shown in FIGS. 10D–10F can be the same as those described with reference to FIGS. 9D–9F. The formation of microtips 14 is a function of the deposition material, deposition angle, rate of deposition and size of apertures 26; so will not be adversely effected by the larger undercut produced in the step of FIG. 10C. A subsequent masking and etching step (not shown) is used to pattern the apertured layer 22, to define the row cross-stripes 24 (see FIG. 5), the pads 27 and the bridging strips 29 (see FIG. 3). Row cross-stripes 24 may, for example, be formed with widths of 300–400 microns and spacings of 50 microns. Pads 27 may be formed as 15 micron squares centered at 25 micron pitches over mesh spacings 16 and with bridging strips 29 of 2–4 micron widths. Each pixel may, e.g., have 11×10 pads 27.

In the illustrated embodiments, the cathode current flows to the microtips 14 through the conductive layer 18 and resistive layer 15. The ordering of the layers 15 and 18 may be reversed. Likewise, if desired, the microtips 14 of each subpixel array may be placed on or over a conductive plate located within each mesh spacing 16, spaced from the mesh structure strips. Other nonrectangular arrays of microtips 14 are also possible. Moreover, a mesh may be formed in the gate electrode layer 22 either instead of, or in addition to, forming the mesh in the conductive layer 18. Such variations are to be considered equivalents, without limitation, of the structures described. Furthermore, those skilled in the art to which the invention relates will appreciate that yet other substitutions and modifications can be made to the described embodiments, without departing from the spirit and scope of the invention as defined by the claims below.

What is claimed is:

1. A method of fabricating an electron emitter plate, comprising the steps of:

forming a cathode electrode on a substrate;

forming an extraction electrode on said substrate; and forming an insulating spacer on said substrate between said extraction and cathode electrodes;

forming a conductive mesh structure defining a plurality of mesh spacings on one of said cathode and extraction electrodes:

forming a plurality of arrays of apertures in said extraction electrode, each aperture array being formed within a respective mesh spacing;

forming a plurality of arrays of subcavities in said insulating spacer, the subcavities of each array being formed to be open to neighboring subcavities of the same array and to together define a main cavity, said main cavity of each array being located within a respective mesh spacing; and forming a plurality of arrays of microtips on said cathode structure, each microtip array being formed within a respective mesh spacing, and each microtip being formed within a respective aperture and subcavity.

2. The method of claim 1, wherein said cathode said mesh structure is formed in said cathode electrode; and said extraction electrode is patterned to define pads located centrally within said mesh spacings of said cathode electrode mesh structure, and tracks electrically connecting said pads to neighboring pads; said arrays of apertures being formed on respective ones of said pads.

3. The method of claim 2, further comprising the steps of patterning said cathode mesh structure in stripes having multiple pluralities of said microtip arrays; and patterning said extraction electrode in cross-stripes having multiple pluralities of said aperture arrays; said stripes and cross-stripes being patterned to intersect at pixel-defining locations defined by aligned corresponding ones of said microtip array and aperture array pluralities.

4. The method of claim 1, wherein said subcavity arrays are formed to provide each main cavity with a perimetric wall defined by extremities of outer ones of the subcavities of the corresponding subcavity array; and said extraction electrode is formed to be supported centrally of the associated mesh spacing by said perimetric wall.

5. The method of claim 4, wherein said subcavity arrays are formed with subcavities arranged in rows and columns, and with subcavities of the same row open to subcavities in adjacent columns and subcavities of the same column open to subcavities of adjacent rows.

6. The method of claim 5, wherein said subcavity arrays are further formed to define posts within each main cavity, said posts being located between diagonally-adjacent subcavities of different rows and columns; and wherein said extraction electrode is formed to be supported centrally of the associated mesh spacing also by said posts.

7. A method of fabricating an image display device comprising the steps of fabricating an electron emitter plate as defined in claim 1; fabricating an anode plate by forming an anode electrode on another substrate, and depositing cathodoluminescent material in contact with said anode electrode on said another substrate; and fixing said anode plate in spaced position relative to said electron emitter plate.

8. The method of fabricating an image display device of claim 7, wherein said cathode electrode includes said conductive mesh structure; and said extraction electrode is patterned to define pads located centrally within said mesh spacings of said cathode electrode mesh structure, and tracks electrically connecting said pads to neighboring pads; said arrays of apertures being formed on respective ones of said pads.

9. The method of fabricating an image display device of claim 8, further comprising the steps of patterning said cathode mesh structure in stripes having multiple pluralities of said microtip arrays; and patterning said extraction electrode in cross-stripes having multiple pluralities of said aperture arrays; said stripes and cross-stripes being patterned to intersect at pixel-defining locations defined by aligned corresponding ones of said microtip array and aperture array pluralities.

10. A method of fabricating an electron emitter plate, comprising the steps of:

depositing a layer of conductive material on a substrate;

patterning a mesh structure, defining mesh spacings, in the layer of conductive material;

depositing a layer of resistive material on said substrate;

patterning the layers of conductive and resistive material to form a pattern of stripes;

depositing an insulative material over said patterned layers of conductive and resistive material;

depositing another layer of conductive material over said layer of insulating material;

forming pluralities of arrays of apertures in said another layer of conductive material;

etching said layer of insulating material through said apertures to form pluralities of subcavities in respective alignments with and located beneath said apertures; said etching forming said subcavities of each array to be open to neighboring subcavities of the same array;

depositing conductive tip forming material through said apertures to form pluralities of arrays of microtips, each microtip being formed with a respective aperture and subcavity.

11. The method of claim 10, wherein said etching step comprises a first step of etching said layer of insulating material through said apertures to form pluralities of arrays of discrete cavities in respective alignments with said apertures prior to forming said microtips; and a second step of further etching said layer of insulating material through said apertures to etch away walls between said cavities, resulting in formation of enlarged overlapping subcavities.

12. The method of claim 10, wherein said etching step comprises etching said layer of insulating material through said apertures to form pluralities of arrays of overlapping subcavities prior to forming said microtips.

13. The method of claim 10, wherein said etching step is performed to provide openings between some adjacent ones of said subcavities and to leave posts between others adjacent ones of said subcavities.

14. The method of claim 13, wherein said etching step is performed to provide openings between row-adjacent and column-adjacent ones of said subcavities, and to leave posts between diagonally-adjacent ones of said subcavities.

* * * * *